United States Patent [19]

Runnells

[11] 3,937,236

[45] Feb. 10, 1976

[54] ULTRASONIC CLEANING DEVICE

[75] Inventor: Robert R. Runnells, Kaysville, Utah

[73] Assignee: MDT Chemical Company, Gardena, Calif.

[22] Filed: Oct. 7, 1974

[21] Appl. No.: 512,734

[52] U.S. Cl. ..... 134/184; 134/182; 68/3 SS; 259/DIG. 44; 259/72

[51] Int. Cl.[2] ..... B08B 3/12

[58] Field of Search ..... 134/1, 105, 184, 201, 85, 134/92, 154, 182, 183; 68/3 SS; 259/DIG. 44, 72

[56] References Cited

UNITED STATES PATENTS

| | | | |
|---|---|---|---|
| 2,151,354 | 3/1939 | Osuch | 134/105 X |
| 2,448,490 | 8/1948 | Karlstrom | 134/182 |
| 2,702,260 | 2/1955 | Massa | 134/1 |
| 2,860,646 | 11/1958 | Zucker | 134/1 X |
| 2,875,989 | 3/1959 | Toulmin, Jr. | 259/DIG. 44 |
| 2,994,330 | 8/1961 | Cottin et al. | 134/1 X |
| 3,073,578 | 1/1963 | Jeffrey, Jr. | 259/72 X |
| 3,111,952 | 11/1963 | Roehl | 134/105 |
| 3,134,990 | 6/1964 | Bodine, Jr. | 259/72 X |
| 3,250,283 | 5/1966 | Reinfeld | 134/92 |
| 3,295,541 | 1/1967 | Ummel | 134/182 |
| 3,352,311 | 11/1967 | Murphy | 134/92 X |
| 3,410,116 | 11/1968 | Levinson | 68/3 SS |
| 3,478,758 | 11/1969 | Davies | 134/85 |
| 3,596,883 | 8/1971 | Brech | 259/72 |

FOREIGN PATENTS OR APPLICATIONS

| | | | |
|---|---|---|---|
| 1,512,498 | 1/1968 | France | 134/182 |

*Primary Examiner*—Robert L. Bleutge
*Attorney, Agent, or Firm*—Trask & Britt

[57] ABSTRACT

The ultrasonic cleaning device includes an ultrasonic radiation insulated container for holding a cleaning detergent. A first perforated basket for holding medical or dental tools is carried within the container. The open end of the container is closed by a cover having a peripherally attached rubber gasket and having its bottom side molded with waffle-like indentations for reflecting and/or absorbing ultrasonic radiation. The container and first perforated basket are sized such that one or more baskets can be carried on top of the first basket or, in the alternative, can be fitted with a stainless steel template having a pair of openings for receiving a glass container. The ultrasonic cleaning device is adapted with an automatic timer and a voltage regulator for varying the voltage input which, in turn, varies the ultrasonic frequency introduced into the cleaning detergent. The device is designed to produce a frequency of about one megacycle and can complete the cleaning cycle within 5–15 minutes. The use of an ultrasonic insulated container and cover prevents or minimizes the emission of ultrasonic radiation into an area immediately outside of the container.

14 Claims, 9 Drawing Figures

ULTRASONIC CLEANING DEVICE

BACKGROUND OF THE INVENTION

Field

This invention relates to a cleaning apparatus and particularly to an apparatus for cleaning dental and medical equipment by means of ultrasonic vibrations.

State of the Art

There are a number of ultrasonic cleaning devices commercially available for cleaning medical and dental tools and/or equipment. Most all of these devices utilize an electroacoustic transducer or a magnetostrictive oscillator for producing a suitable high vibrating frequency.

Most of the cleaning devices currently available on the market are not specifically adapted to reduce or minimize the amount of ultrasonic radiation escaping to the atmosphere, and as a result only a small amount of the ultrasonic radiation is effectively retained within the cleaning unit. In some units 70% to 90% of the emitted ultrasonic radiation eventually escapes to the outside of the cleaning unit. This large amount of radiation loss could be hazardous to the health of operators who are working in close proximity to the cleaning device.

In other commercially available units, the cleaning units are designed to perform a single cleaning function and do not possess the versatility for cleaning sets or classes of instruments used in medical or dental operations. For example, if two or more sets of medical or dental instruments and devices are to be cleaned, it is generally necessary to place all of the items in one cleaner or to utilize two separate cleaners or cleaning operations. Cleaners with shelf-like compartments which would permit various sets of instruments and devices to be cleaned as a group are generally not available. Currently color coding of special sets of instruments is utilized as a means for keeping the instruments separated during the cleaning operation. Compact ultrasonic cleaning devices which are designed specifically for preventing or substantially reducing ultrasonic radiation loss are not readily available.

Objects of the Invention

It is therefore an object of this invention to provide an ultrasonic cleaning unit which substantially minimizes ultrasonic radiation losses. Another object is to provide an ultrasonic cleaner having ultrasonic radiation insulated side walls and a cover adapted with a reflective and/or absorptive inside wall which will contain ultrasonic radiation. Still another object is to provide a cleaning unit which is compact and which is capable of maintaining separate individual sets of medical or dental instruments or devices during a cleaning operation.

Summary of the Invention

The ultrasonic cleaning unit of this invention comprises broadly an external housing or cabinet for supporting a liquid cleaner container. That portion of the container housed within the cabinet is wrapped with a resilient material capable of absorbing and/or reflecting ultrasonic radiation. The container is closed by means of a cover having a peripheral rubber gasket and containing molded indentations on its inner face for absorbing and reflecting ultrasonic radiations. The container is designed to receive dividers or at least two free standing baskets and/or to carry at least one or two impervious glass containers for holding materials or items to be cleaned. A means and controls are also provided for introducing an ultrasonic frequency into a cleaning solution carried by the container. More specifically, the means for covering the container comprises a molded thermoplastic cover having a plurality of concave inwardly slanted indentations for absorbing and/or reflecting ultrasonic radiations. The cover is preferably nonmetallic and is made from a material which is characterized by its ability to absorb and/or reflect ultrasonic radiations. Preferably the nonmetallic material is a thermoplastic material having its inner face molded with a type of waffled design such that ultrasonic radiations can be reflected back into the cleaning solution. That portion of the ultrasonic radiation which is not reflected is absorbed in the thermoplastic material and thereby insures that a minimum, if any, of the ultrasonic radiation is lost to an area outside of the cleaning unit.

DESCRIPTION OF THE PREFERRED EMBODIMENT

Figure 1:
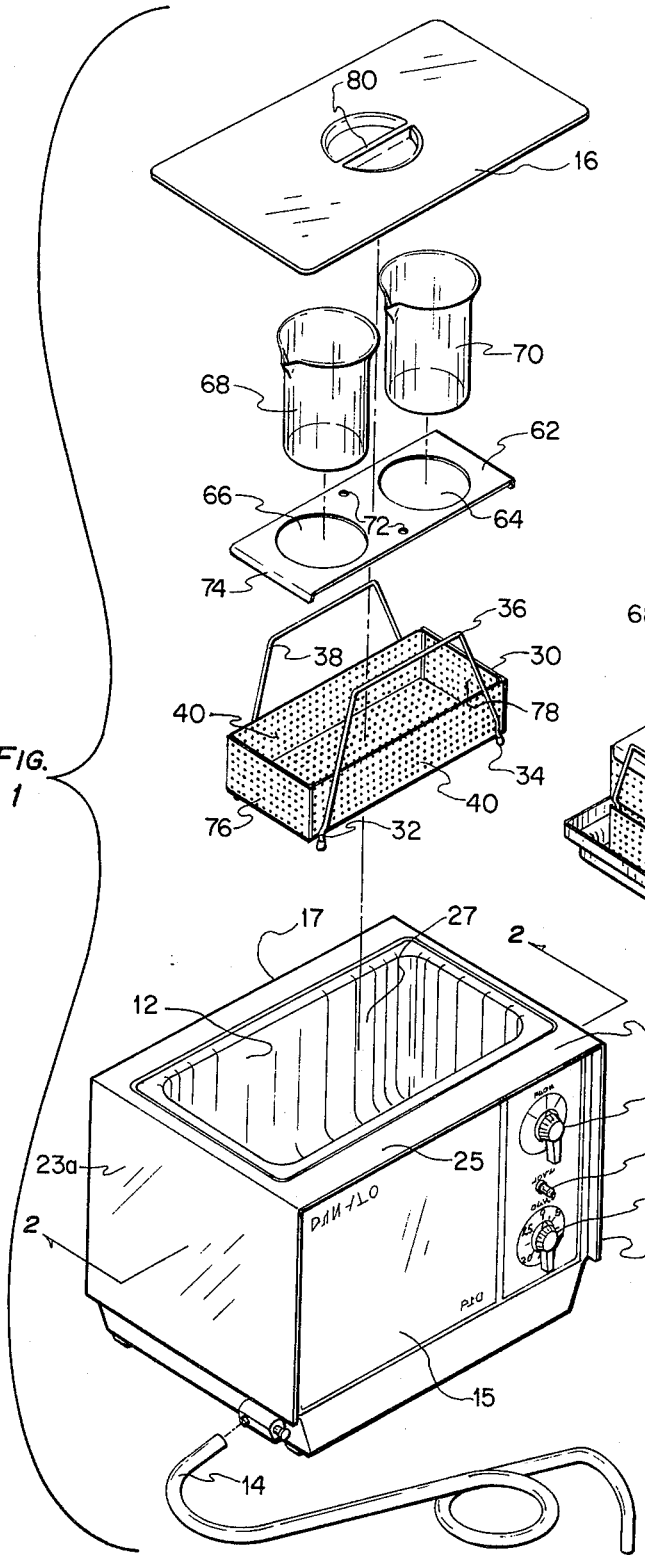
FIG. 1 is an exploded perspective view of the ultrasonic cleaning device of this invention wherein the device is fitted with a template for holding a glass container.
Figure 4:
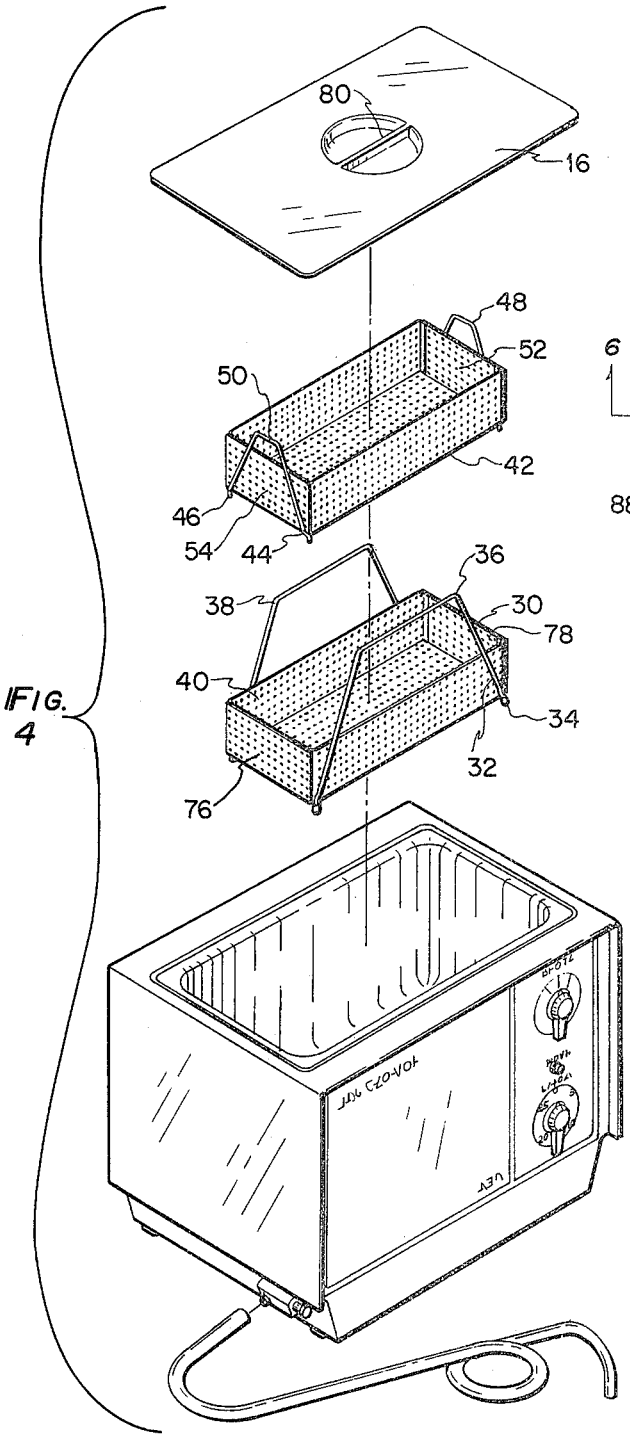
FIG. 4 is an exploded perspective view of the ultrasonic cleaning device of this invention wherein the device contains a pair of stacked baskets.
Figure 5:
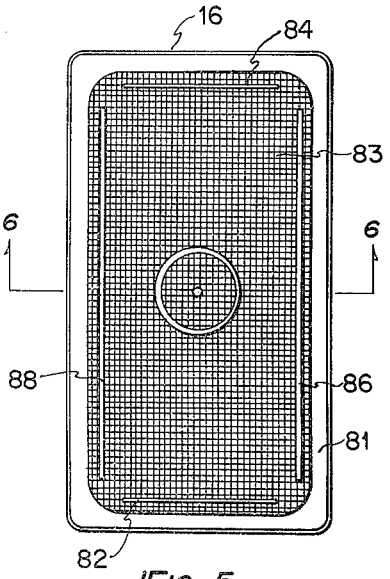
FIG. 5 is a bottom elevation view of the cover used in covering the container.

As shown in FIGS. 1 and 4, the ultrasonic cleaning device of this invention includes an outer shell or cabinet 10 fitted with a stainless steel container 12 for holding a cleaning solution. The container has a drain outlet 14 and a cover 16 which shall be described in more complete detail later in this disclosure.

Figure 2:
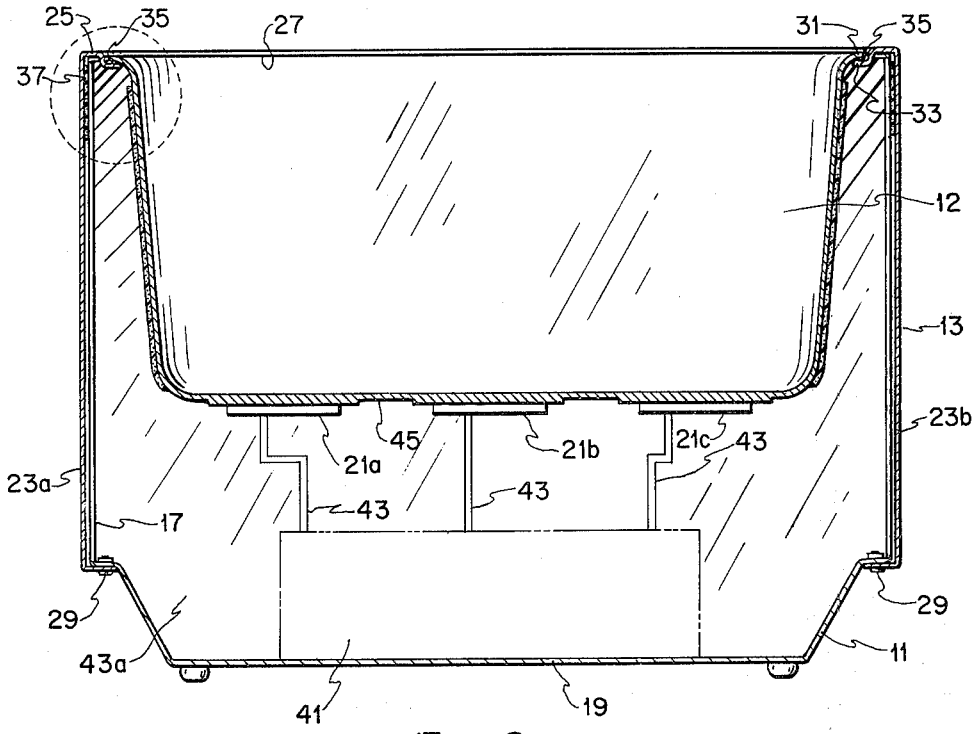
FIG. 2 is a cross sectional view of the cabinet and liquid cleaning container taken along line 2—2 of FIG. 1.
Figure 9:
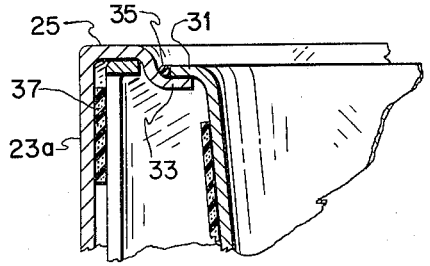
FIG. 9 is an enlargement of that section of FIG. 2 designated by a dotted circle.

As shown in FIG. 2, the cabinet is formed in two sections 11 and 13, respectively. The first section comprises a front and back wall 15 and 17 and a bottom wall 19. The second section 13 overlies the first section 11 and includes two side walls **23*a* and 23*b* and a top member 25 having a large cut-out center section 27 for receiving the container 12. The two sections are held in position by corner mounted screws 29**.

The container 12 has an outwardly extending peripheral lip 31 which is sealed to an inwardly extending ledge 33 of the top member 25 by a rubber seal 35. The rubber seal 35 provides a watertight closure between the container and the top member 25.

A cushion of resilient material 37 such as foam rubber is cemented to the inturned edges of the front and back wall 15 and 17 of the first section to reduce, if not eliminate, any vibratory noise resulting from metal to metal contact between the front and back walls 15 and 17 and the side walls 23*a* and 23*b* during operation of the ultrasonic cleaning device.

The ultrasonic vibrations necessary to produce a cleaning action are produced by a transducer and related electrical components 41 which are depicted generally in FIG. 2 by a broken line rectangular box. The transducer and its related electrical components are housed in the space 43*a* located between the bottom wall 45 of the container 12 and the bottom wall 19 of the cabinet 10. The vibrating frequency generated by the transducer 41 is transferred to the container 12 by means of electrical connectors 43 and three vibratory disks 21*a*, 21*b* and 21*c* mounted to the bottom wall 45 of the container 12.

The voltage applied to the transducer 20 is determined by a voltage control knob 22 located on the front side of the cabinet 10. The length of time the ultrasonic vibrations are being introduced into the cleaning solution is controlled by an automatic timer 24, having controls located on the outside of the cabinet 10. An indicator light 26 is also provided on the face of the cabinet to indicate when the cleaning unit is in operation.

Figure 8:
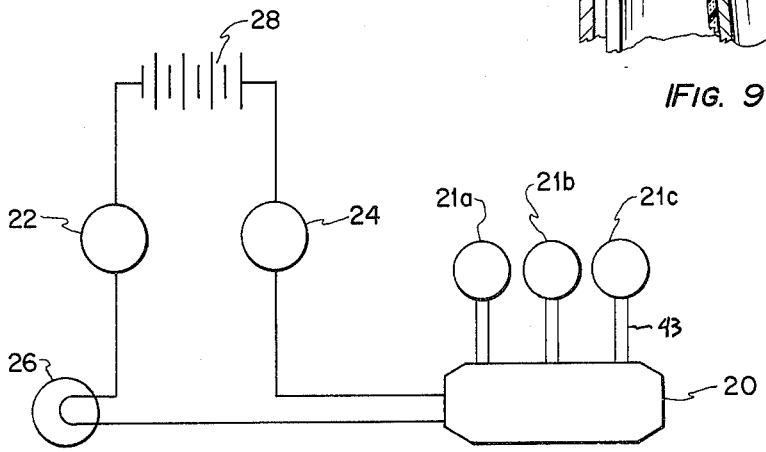
FIG. 8 is an electrical diagram showing generally the relationship between the controls and transducer.
Figure 6:
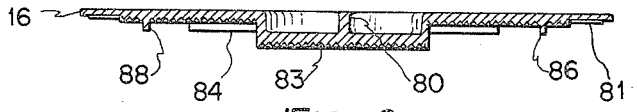
FIG. 6 is a cross sectional view of the cover taken along line 6—6 of FIG. 5.

In FIG. 8 a simple circuit diagram is depicted showing generally the timer 24, the indicator light 26 and voltage regulator 22 in series with the transducer 20. Electrical connectors 43 lead from the transducer to vibratory disks 21*a*, 21*b* and 21*c* mounted to the bottom wall of the container. The electrical energy needed to operate the unit is provided from a 110–120 volt source 28.

Carried within the container 12 is a first perforated free standing basket 30, having four downwardly extending legs 32 adapted with nonmetallic tips 34. Extending upward from each leg along the basket's side walls is a continuous metallic handle rod 36 and 38, respectively. These handle rods are bent and are of such length that they are at least twice the height of the basket's side walls 40. A second perforated free standing basket 42 having legs 44 and tips 46 is designed and possesses dimensions such that it is capable of fitting on top of the first basket 30. The second basket is likewise adapted with bent rod handles 48 and 50 which extend upward from the basket's front and back wall 52 and 54, respectively. The length of the bent rod handles are such that they extend just a short distance over the basket's front and back wall. The handles of both baskets are such that when the second basket is resting on the first basket, the handles of the two baskets extend over the top basket's walls a short distance, that is, a distance which will not hinder the closing of the container. This feature is more clearly shown in FIG. 3, where the baskets 30 and 42 are shown resting on a drainage tray 60.

Figure 3:
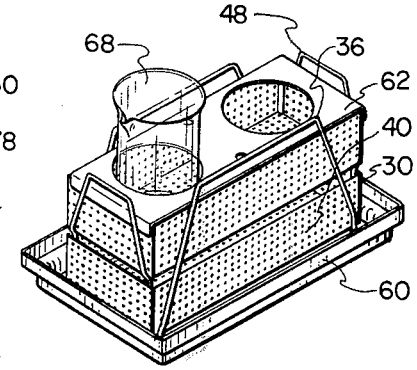
FIG. 3 is a perspective view showing stacked baskets and a glass container resting on a drainage tray.

A variation of FIG. 3 is shown in FIG. 1 where the second basket 42 is omitted and instead a stainless steel template 62 having a pair of openings 64 and 66 for accommodating a pair of glass beakers 68 and 70, respectively. Smaller openings 72 are also provided to permit liquid and/or liquid vapor to pass therethrough. The template is bent at its front and rear end to form a lip 74 for fitting over the front and rear top edge of the basket's 30 front and back walls 76 and 78.

With the baskets within the container, the container is closed by a cover 16. The cover is a rectangular piece of translucent thermoplastic having a recessed top handle 80 and a rubber gasket 81 fixed to its bottom face. The cover's bottom face is molded into a type of waffle design 83. The cover preferably has a thickness of from 1/16 to ¼ inch and includes a pair of opposed outer transverse and longitudinal ribs 82, 84, 86 and 88. These ribs are positioned inwardly from the outer edges of the cover and in substantially parallel relationship thereto. In addition, the ribs are positioned to fit within the container when the cover is resting on top of the container. This arrangement, in combination with the rubber gasket 81, provides for a close fit and minimizes vibratory noises and avoids the inadvertent loss of cleaning solution from the container. Although baskets, beakers, trays and the like are specifically disclosed for separating the medical and dental instruments during cleaning, other dividing or compartmentalizing means such as adjustable dividers, shelves and the like may also be used.

Figure 7:
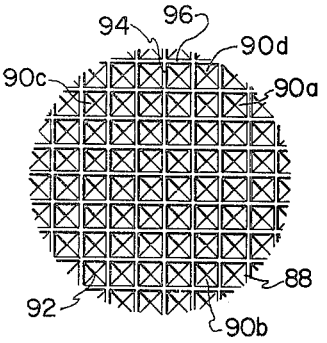
FIG. 7 is an enlarged bottom elevation of a portion of the waffle baffling used on the underside of the cover shown in FIG. 5.

An enlargement of the cover's waffle design referred to above is shown in FIG. 7. As shown, the design contains a series of squares 88 with each square containing triangular, inwardly slanted wall sections indicated by numerals 90*a*, 90*b*, 90*c* and 90*d*, respectively. These slanted walls meet at its apex 92 located in the center of each square. This arrangement allows the ultrasonic radiation to be reflected downwardly from the slanted walls into the cleaning solution. The slanting of the walls also permits the ultrasonic radiation to enter the absorbing material longitudinally rather than perpendicularly and thus increase the cover's absorptive properties. It has been found that the reflective action of the slanted walls tends to increase the absorptive characteristics of the lining without increasing the layer's thickness. The squares 88 are formed and separated by crisscrossing ribs 94 and 96, respectively. The arrangement above described provides design which can generally be described as "waffle-like design".

Operation

In operation the container 12 is filled approximately ½ to ¾ full with a cleaning solution such as a detergent, caustic, acid and the like. One or more of the baskets 30 and 42 or other similar series of shelf-like dividers, or a basket 30 and the template 32, are then placed within the container 12. When a single basket in combination with a template is used, one or two of the glass beakers 68 and 70 are inserted in the openings of the template 62. Medical or dental instruments and/or devices (not shown) are placed in one or more of the baskets or in the beakers and the container is closed with the cover 16. The timer is set for approximately 5 to 15 minutes, depending on the degree of cleaning required or the amount of voltage applied to the vibratory transducer 20. The cleaner is turned on by turning the voltage regulator 22 to a voltage input ranging from between about 95 to 125 volts. Generally, the cleaning time can be reduced by increasing the voltage to the transducer and thereby increasing the ultrasonic vibrations. Generally, though, the cleaning device will be operated at between 600 and 1300 kilocycles. After the cleaning has been completed, the baskets are removed from the container and placed on a drainage tray for rinsing and subsequent sterilization.

During the cleaning cycle, it was determined that up to 90 percent of the ultrasonic radiations were retained within the ultrasonic cleaning device and thereby reduced radiations losses to approximately 10 percent.

While the invention has been described with reference to specific embodiments, it should be understood that certain other changes in construction may be made by one skilled in the art and would not thereby depart from the spirit and scope of this invention which is limited only by the claims appended hereto.

I claim:

1. An ultrasonic cleaning device comprising:

a housing and an inner container both having side walls and a bottom wall, said inner container being suspended within the housing and separated from the housing by an acoustical energy-absorbing material positioned therebetween;

a means for transferring ultrasonic vibrations through the container; and a cover for said container, said cover containing a plurality of concave indentations on its inner surface for absorbing and/or reflecting ultrasonic radiation.

2. The device of claim 1 including a perforated basket for positioning within the inner container.

3. The device of claim 2 including a second perforated basket stacked on said first perforated basket.

4. The device of claim 3 wherein the baskets include upstanding handles carried within the closed container and the second named basket fits within the handles of the first named basket so that the second named basket may be lifted from the container by either its own handles or together with the first named basket by the handles of said first named basket.

5. The device of claim 2 wherein said perforated basket carries a cover template having openings for receiving a plurality of glass containers so that the glass containers are kept physically separated during the transfer of ultrasonic vibrations through the said inner container while said glass containers are entirely contained within said inner container.

6. The device of claim 2 wherein the perforated basket is mounted within the inner container on legs having nonmetallic tips.

7. The device of claim 2 wherein said perforated basket is free standing.

8. The device of claim 1 including a means for varying the voltage used in producing the ultrasonic frequencies.

9. The device of claim 8 including a means for controlling the length of time the ultrasonic frequency is being introduced into the container.

10. The device of claim 1 wherein the cover used in closing the container is constructed of thermoplastic material with the inner surface molded in a waffled pattern capable of retaining up to 90 percent of the ultrasonic radiation within the container.

11. The device of claim 10 wherein the cover includes a plurality of concave indentations for reflecting and absorbing ultrasonic radiations.

12. The device of claim 11 wherein said concave indentations are formed on a sheet of material affixed to the bottom wall of said cover and wherein such material possesses ultrasonic absorbing characteristics.

13. The device of claim 12 including a gasket attached at or near the peripheral edge of said cover.

14. The device of claim 1 including a means for compartmentalizing said inner container to physically segregate instruments placed in individual compartments during the transfer of ultrasonic radiation through said container while permitting free flow of cleaning solution throughout and between all compartments.

* * * * *